US006594859B2

(12) United States Patent
Barthelemy et al.

(10) Patent No.: US 6,594,859 B2
(45) Date of Patent: Jul. 22, 2003

(54) HINGE ASSEMBLY FOR A SWINGING DOOR OF A MOTOR VEHICLE

(75) Inventors: Fabrice Barthelemy, Verneuil sur Seine (FR); Mirca Barbu, Paris (FR)

(73) Assignee: Oxford Automotive Mecanismes et Decoupage Fin, Les Ulis (FR)

( * ) Notice: Subject to any disclaimer, the term of this patent is extended or adjusted under 35 U.S.C. 154(b) by 0 days.

(21) Appl. No.: 09/783,325

(22) Filed: Feb. 15, 2001

(65) Prior Publication Data

US 2001/0013155 A1 Aug. 16, 2001

(30) Foreign Application Priority Data

Feb. 15, 2000 (FR) ..... 00 01856

(51) Int. Cl.[7] ..... E05D 11/10

(52) U.S. Cl. ..... 16/334; 16/335; 16/308; 296/146.11

(58) Field of Search ..... 16/335, 334, 345, 16/308, 332, 86 C, 366; 296/146.11, 146.12

(56) References Cited

U.S. PATENT DOCUMENTS

| | | | | |
|---|---|---|---|---|
| 3,065,497 A | * | 11/1962 | Faber | |
| 3,820,192 A | * | 6/1974 | Nakano et al. | |
| 3,905,064 A | * | 9/1975 | Brockhaus | |
| 3,969,789 A | * | 7/1976 | Wize | 16/145 |
| 4,285,098 A | * | 8/1981 | Hicks et al. | 16/145 |
| 4,720,895 A | * | 1/1988 | Peebles | 16/264 |
| 4,932,101 A | * | 6/1990 | Lualdi | 16/255 |
| 5,297,314 A | * | 3/1994 | Bender et al. | 16/270 |
| 5,323,512 A | * | 6/1994 | Little | 16/332 |
| 5,509,175 A | * | 4/1996 | Baughan et al. | 16/332 |
| 5,675,869 A | * | 10/1997 | Lotz | 16/334 |
| 5,794,309 A | * | 8/1998 | Lotz | 16/334 |
| 5,850,673 A | * | 12/1998 | Wood, Sr. et al. | 16/334 |

FOREIGN PATENT DOCUMENTS

| | | | |
|---|---|---|---|
| DE | 2612032 A1 | * | 9/1977 |
| DE | 3223938 A1 | * | 12/1983 |
| FR | 2710365 A3 | * | 3/1995 |
| GB | 1 509 057 | | 4/1978 |
| WO | WO 92/22722 | | 12/1992 |

* cited by examiner

*Primary Examiner*—Anthony Knight
*Assistant Examiner*—Alison K. Pickard
(74) *Attorney, Agent, or Firm*—Young & Thompson

(57) ABSTRACT

A hinge assembly for a motor vehicle door with a built-in door stop includes a fixed knuckle having a first part which has a drilling allowing the fixed knuckle to be attached to the bodywork of the vehicle, and a second part perpendicular to the first part having a drilling to accommodate a pin about which the hinge pivots. The hinge assembly also includes a moving knuckle having a drilling allowing the moving knuckle to be attached to the door and having two approximately horizontal flat zones, each provided with a drilling to take the pin and each having a notched cam. The hinge assembly further includes two pressing rollers kept in contact with a cam of the moving knuckle and a spring held in the fixed knuckle and having two vertical branches inserted in the rollers and working in bending, causing the rollers to exert pressure on the cams. The pin articulates the moving knuckle to the fixed knuckle.

6 Claims, 2 Drawing Sheets

HINGE ASSEMBLY FOR A SWINGING DOOR OF A MOTOR VEHICLE

BACKGROUND OF THE INVENTION

The invention relates to the field of the motor industry. More specifically, it relates to a hinge assembly for a swinging side door of a motor vehicle comprising a built-in door stop.

In general, the motor industry uses three elements for attaching the swinging side door of a vehicle, pivoting it, and keeping it in a predefined angular position. These elements are an upper hinge and a lower hinge, both allowing for the attachment and pivoting of the door, and a door stop system allowing the door to be held in one or more predefined angular positions. The door stop system also has the function of stopping the door when it reaches its wide open position.

In certain instances, at least one of the two hinges comprises a door stop device which is built into it. Such door hinges with built-in door stops are described, in particular, in the following documents: DE 29806087, DE 19642597, EP 0 794 308, DE 29604089, DE 19606186 and EP 0 769 600. They comprise in particular a wire spring working in torsion and wound around a series of rollers.

The hinges with built-in door stops that already exist on the market have various drawbacks. Firstly, they are bulkier than conventional hinges because of the presence of the door stop system. The vehicle environment has therefore to set aside a substantial volume in order to allow this type of hinge to be fitted. Furthermore, because the door stop devices comprise metal parts rubbing on one another, they give out a banging or grinding noise when the door is being manoeuvred. Motor manufacturers now wish to eliminate this type of noise which the user finds unpleasant. In addition, the mutual rubbing of metal parts wears off the anti-corrosion coating that they might have before being fitted; this then creates the possibility of corrosion of these very parts. Finally, with a view to lessening the operating noise of the door stop system, it is commonplace for this system to be greased at the end of vehicle assembly. However, it is periodically necessary to renew this grease during vehicle servicing operations, and motor manufacturers would like to eliminate this greasing stage. Furthermore, dirt builds up inside the grease in the course of the life of the vehicle, and this may lead to abrasion of the parts as they rub.

SUMMARY OF THE INVENTION

The object of the invention is to provide motor manufacturers with a hinge assembly for a swinging door of a vehicle comprising a built-in door stop system which is free of at least some of the aforementioned drawbacks. In particular, such a device should optimally be of small bulk, should not cause undesirable noise when operating, and should not require greasing during the life of the vehicle.

To this end, a subject of the invention is a hinge assembly for a swinging door of a motor vehicle, characterized in that it comprises:

- a first knuckle, known as the fixed knuckle, comprising a first part, the overall orientation of which is a horizontal straight line, equipped with at least one horizontal drilling allowing it to be attached to a fixed part of the bodywork of the said vehicle, and a second part, the overall orientation of which is a horizontal straight line approximately perpendicular to that of the said first part, and the end of which comprises a vertical drilling to house the pin about which the hinge pivots;
- a second knuckle, known as the moving knuckle, the overall orientation of which is vertical, comprising, at each of its ends, drillings allowing it to be attached to the said door and comprising two approximately horizontal flat zones, each provided with a vertical drilling so that the hinge pin can pass through them and each comprising a notched cam;
- two pressing rollers intended to be kept in contact with a corresponding cam of the moving knuckle;
- a spring held in the said fixed knuckle and having two vertical branches inserted in the said rollers and working mainly in bending so as to cause the said rollers to exert pressure on the said cams; and
- a hinge pin articulating the moving knuckle to the fixed knuckle.

As will have been understood, the invention consists in equipping the moving knuckle with two notched cams against which a spring, held by the fixed knuckle and working mainly in bending, presses two rollers.

BRIEF DESCRIPTION OF THE DRAWINGS

The invention will be better understood with the aid of the description which follows which is given with reference to the following appended figures.

DETAILED DESCRIPTION OF THE PREFERRED EMBODIMENTS

Figure 1:
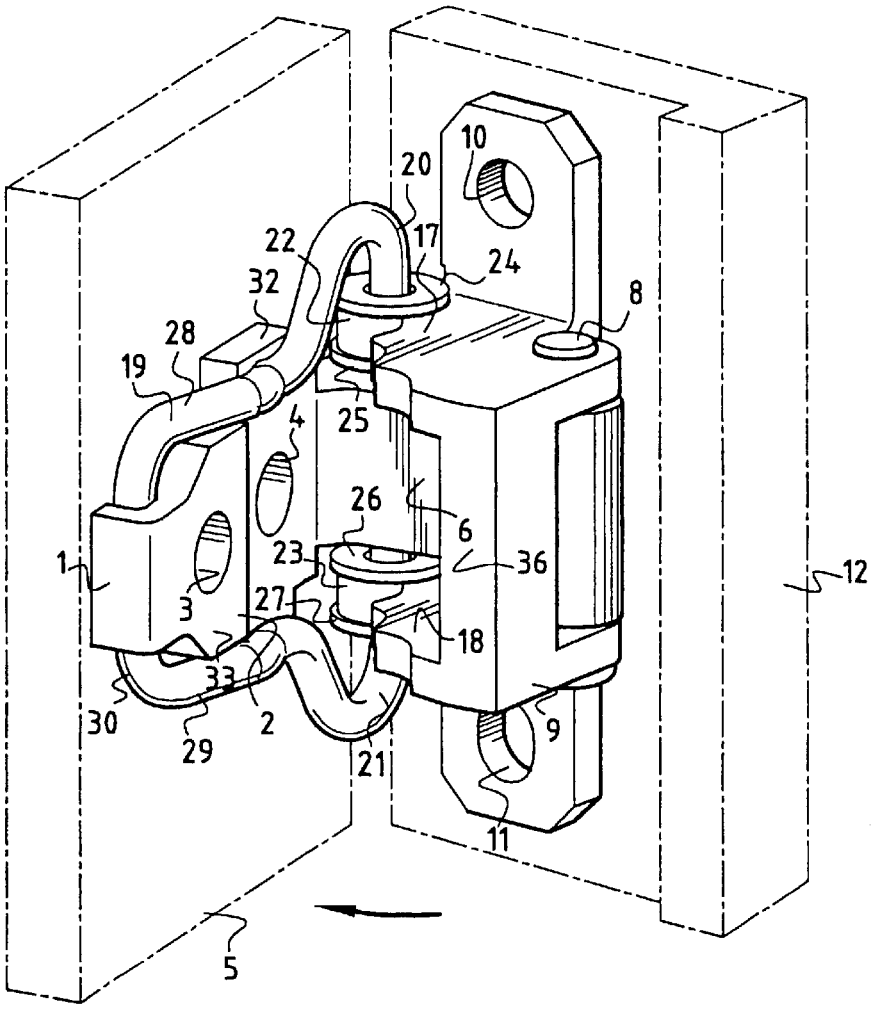
FIG. 1 which shows a hinge assembly according to the invention, mounted on a vehicle and seen in perspective.

The hinge assembly according to the invention comprises a first knuckle, known as the fixed knuckle 1. It is made of a metallic material such as steel, preferably coated with a layer that protects it against corrosion, or an aluminium alloy. It comprises a first part 2, the overall orientation of which is a horizontal straight line, with two horizontal drillings 3, 4 allowing it to be attached to a fixed part 5 of the bodywork of a vehicle by means of screws (not depicted) or any other equivalent means. This fixed knuckle 1 comprises a second part 6, the overall orientation of which is a horizontal straight line approximately perpendicular to the orientation of the said first part 2. At the end of this second part 6 there is a vertical or approximately vertical drilling 7, in which the pin 8 about which the hinge pivots is housed.

The hinge assembly comprises a second knuckle known as the moving knuckle 9. This has a vertical overall orientation and at each of its end has a drilling 10, 11 allowing it to be attached to a vehicle door 12 by means of attachment screws (not depicted) or any other equivalent means. In its central part, the moving knuckle 9 has two approximately horizontal flat zones 13, 14. They each comprise a vertical drilling 15, 16 through which the hinge pin 8 passes when the hinge is assembled. The flat zones 13, 14 also each comprise a notched cam 17, 18. In the example depicted, the cams 17, 18 have four notches corresponding respectively to a closed position of the door 12 (as depicted in FIG. 1), two possible positions in which the door 12 is partially open, and a position in which the door 12 is wide open. In order for it constantly to exhibit good resistance to corrosion, particularly in the zones subjected to rubbing that the cams 17, 18 constitute, the moving knuckle 9 is preferably made of a non-corrodable metal, such as an aluminium alloy.

A spring fulfils the door stop function, in collaboration with the cams 17, 18. This spring 19 comprises two vertical branches 20, 21 inserted in the pressing rollers 22, 23 comprising shoulders 24, 25, 26, 27. Following the vertical branches 20, 21, the spring 19 comprises two horizontal branches 28, 29, connected by a third vertical branch 30. When the hinge assembly is mounted on the vehicle, this third vertical branch 30 is housed in a groove 31 formed on that face of the fixed knuckle 1 which faces towards the bodywork part 5 to which the fixed knuckle 1 is secured. The spring 19 is thus held between the fixed knuckle 1 and the bodywork part 5. The fixed knuckle 1 also comprises two vertical protrusions 32, 33, against the sides of which the horizontal branches 28, 29 of the spring 19 press when the hinge assembly is mounted. This pressing allows the spring 19 to work mainly in bending, so as to cause the rollers 22, 23 to exert pressure on the cams 17, 18 of the moving knuckle. The rollers 22, 23 thus become lodged in the notches of the cams 17, 18 corresponding to the desired extent of opening to be imposed on the door 12. When the user wishes to open or close the door 12, the pivoting of the door 12 about the pin 8 causes the cams 17, 18 to exert pressure on the rollers 22, 23. These disengage from the notches of the cams 17, 18 and position themselves in the notches corresponding to the new desired position of the door 12. The spring 19 offers a certain amount of resistance to the moving of the door 12, but not enough to prevent this movement. However, the stiffness of the spring 19 is calculated so that it allows the door 12 to be held effectively in position because of the pressure it causes the rollers 22, 23 to exert on the cams 17, 18.

The distances between the shoulders 24, 25 of the roller 22 and the shoulders 26, 27 of the roller 23 are roughly equal to the thickness of the cams 17, 18, so that the rollers are themselves held in position against the cams 17, 18.

The hinge pin 8 is preferably held in position and guided in its pivoting inside the drilling 7 by self-lubricating bushings 34, 35.

As a preference, the rollers 22, 23 are made not of a metallic material but of a plastic. The advantage of such an embodiment is that this then yields metal-to-plastic rubbing between the rollers 22, 23 and the cams 17, 18. By comparison with a configuration in which the rollers 22, 23 are made of metal, the noises associated with metal-to-metal contact and the need of greasing to reduce them are eliminated. However, if the operations of cataphoresis, painting and lacquering the vehicle take place when the door and its hinge assembly have already been assembled, it is necessary for the plastic used to make the rollers 22, 23 to be able to withstand temperatures of the order of 200° C. However, if the essential desired objective is to obtain a hinge assembly of small bulk, it would remain within the spirit of the invention for these rollers 22, 23 to be made of a metallic material, preferably a corrosion-resistant one. The lessening of operating noise is then performed in the conventional way by greasing.

As a variant, each of the rollers 22, 23 (regardless of the material of which they are made) may be fitted with a bushing 44, 45 made of a self-lubricating material (such as PTFE) which performs the rubbing between the roller 22, 23 and the corresponding branch 20, 21 of the spring 19.

One advantage of the hinge assembly according to the invention is that the fact of using two rollers 22, 23 allows the holding force exerted on the hinge assembly to be spread well. This force creates no couple and prevents cantilevering at the hinge, by virtue of the symmetry of the construction of the assembly.

As a preference, the moving knuckle 9 in its central part comprises a vertical flat surface 36 which butts against the fixed knuckle 1 when the door 12 is in the wide-open position.

Figure 3:
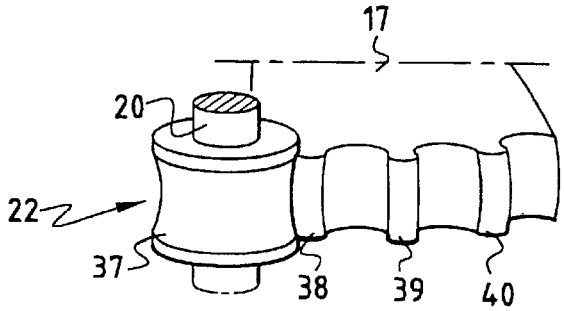
FIG. 3 which shows a detail of a variant of the invention.
Figure 2:
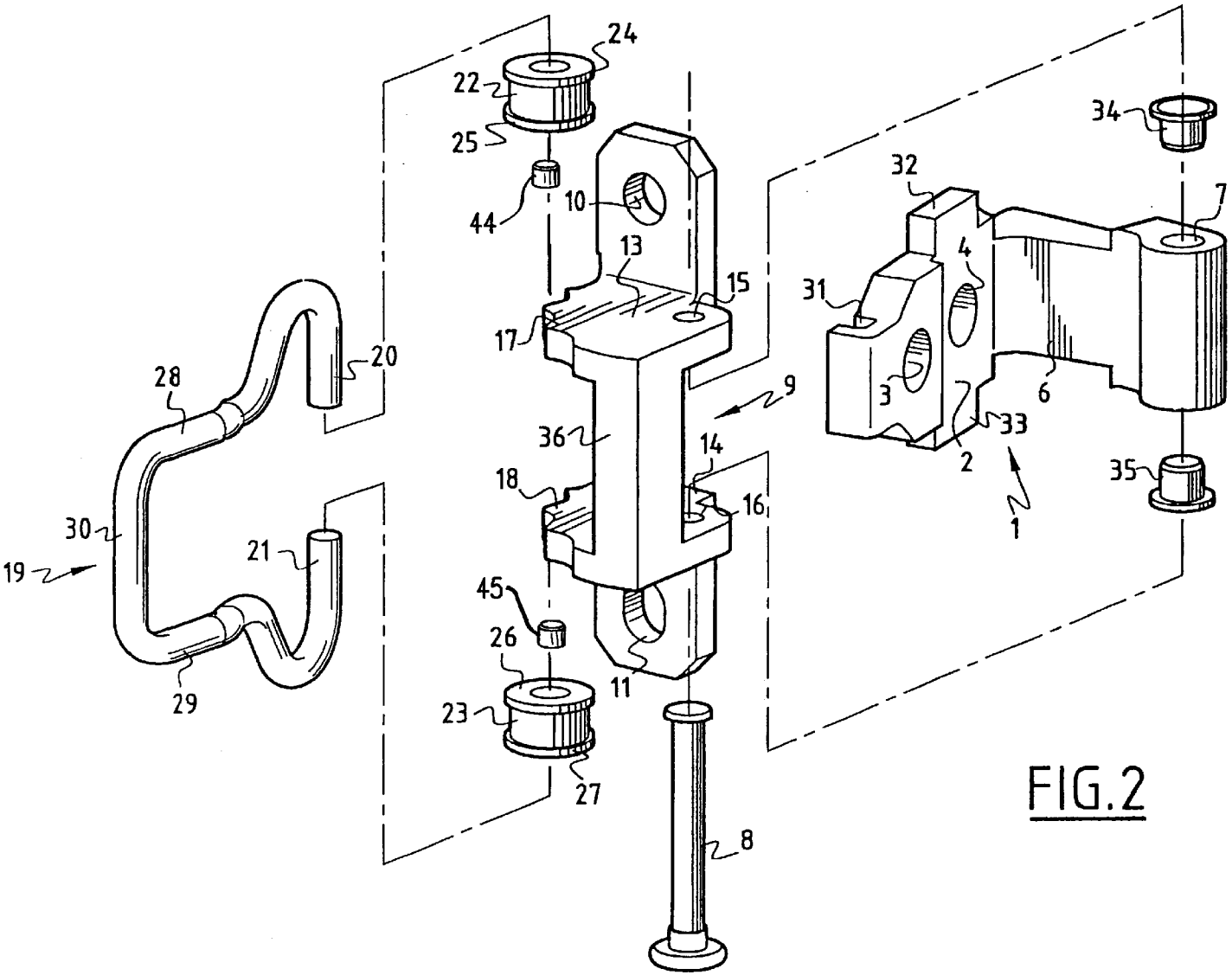
FIG. 2 which shows this same hinge assembly in an exploded view.

As a variant, provision could be made for the external surfaces of the rollers 22, 23 to have a concave shape and for the shoulders 24, 25 and 26, 27 to be eliminated, as depicted in FIG. 3. Under such conditions, the protruding parts constituting the teeth of the cams is given a convex shape corresponding to the said concave shape. This is what is depicted in FIG. 3 where the roller 22, through which the vertical branch 20 of the spring 19 passes, has a concave external surface 37 designed to be inserted between the protruding parts 38, 39, 40 of the cam 17. These projecting parts themselves have a convex shape corresponding to the concave shape of the external surface 37. This thus yields self-centring of the roller 22 on the cam 17. Thus, if, during the life of the hinge assembly, the roller 22 should experience wear, this can automatically be compensated for by a pivoting of the roller 22, so as to maintain the quality of its contact with the cam 17. The elimination of the shoulders 24, 25, 26 and 27 means that this possibility of pivoting is not impeded.

Thanks to the invention, motor manufacturers have available a hinge assembly of simple design containing a very small number of parts which is easy to mount and has a small bulk. The manufacturer may, as he chooses, equip the vehicle door either with two hinge assemblies according to the invention or with a single hinge assembly according to the invention and with a hinge assembly of conventional type which has no door stop device. To do this, a device according to the invention from which the spring 19 and the rollers 22, 23 have been removed could be used.

What is claimed is:

1. Hinge assembly for a swinging door of a motor vehicle with a built-in door stop, comprising:

a first knuckle, known as the fixed knuckle, comprising a first part, the overall orientation of which is a horizontal straight line, equipped with at least one horizontal drilling allowing the first knuckle to be attached to a fixed part of a bodywork of the vehicle, and a second part, the overall orientation of which is a horizontal straight line approximately perpendicular to that of said first part, and the end of which comprises a vertical drilling to house a pin about which the hinge pivots;

a second knuckle, known as the moving knuckle, the overall orientation of which is vertical, comprising at least one drilling allowing the second knuckle to be attached to the door and comprising two approximately horizontal flat zones, each provided with a vertical drilling so that the pin can pass through them and each comprising a notched cam;

two pressing rollers intended to be kept in contact with a corresponding cam of the moving knuckle; and a spring held in said fixed knuckle and having two vertical branches which are vertically aligned and inserted in said rollers and working mainly in bending so as to cause said rollers to exert pressure on said cams, said pin articulating the moving knuckle to the fixed knuckle.

2. Hinge assembly according to claim 1, wherein said spring comprises, following the two vertical branches, two horizontal branches connected by a third vertical branch, and wherein said fixed knuckle comprises a groove formed on a face of said fixed knuckle intended to face towards the bodywork part, intended to take the third vertical branch of the spring, and two vertical protrusions formed on the first straight part of the fixed knuckle and intended to constitute points on which the horizontal branches of the spring can press, allowing the spring to work mainly in bending.

3. Hinge assembly according to claim 1, wherein the moving knuckle comprises a vertical flat surface abutting against said fixed knuckle when the door is in a wide-open position.

4. Hinge assembly according to claim 1, wherein said rollers are made of plastic.

5. Hinge assembly according to claim 1, wherein said rollers are fitted with a bushing made of a self-lubricating material which performs the rubbing between one of the rollers and a corresponding one of the two vertical branches of the spring which is inserted into said one of the rollers.

6. Hinge assembly according to claim 1, wherein said rollers have an external surface of concave shape, and wherein protruding parts constituting teeth of the cams have a convex shape corresponding to the concave shape of the external surface of said rollers.

* * * * *